US011603645B2

(12) United States Patent
Kim et al.

(10) Patent No.: US 11,603,645 B2
(45) Date of Patent: Mar. 14, 2023

(54) HYDRAULIC CIRCUIT

(71) Applicant: Volvo Construction Equipment AB, Eskilstuna (SE)

(72) Inventors: Dongwook Kim, Gyeongsangnam-do (KR); Manseuk Jeon, Gyeongsangnam-do (KR); Seonggeun Yun, Gyeongsangnam-do (KR); Youngjin Son, Gyeongsangnam-do (KR)

(73) Assignee: Volvo Construction Equipment AB, Eskilstuna (SE)

( * ) Notice: Subject to any disclaimer, the term of this patent is extended or adjusted under 35 U.S.C. 154(b) by 69 days.

(21) Appl. No.: 16/762,575

(22) PCT Filed: Nov. 8, 2017

(86) PCT No.: PCT/KR2017/012626
§ 371 (c)(1),
(2) Date: May 8, 2020

(87) PCT Pub. No.: WO2019/093538
PCT Pub. Date: May 16, 2019

(65) Prior Publication Data

US 2020/0362537 A1 Nov. 19, 2020

(51) Int. Cl.
*E02F 9/22* (2006.01)

(52) U.S. Cl.
CPC ..... *E02F 9/2292* (2013.01); *E02F 9/2285* (2013.01); *E02F 9/2267* (2013.01); (Continued)

(58) Field of Classification Search
CPC ..... E02F 9/2239; E02F 9/2242
See application file for complete search history.

(56) References Cited

U.S. PATENT DOCUMENTS 7,571,558 B2 * 8/2009 Horii ..... E02F 9/2239 37/348
8,424,301 B2 * 4/2013 Choi ..... E02F 9/2207 60/421

(Continued)

FOREIGN PATENT DOCUMENTS

EP 1306492 A1 5/2003

OTHER PUBLICATIONS

International Search Report and Written Opinion of the International Searching Authority, PCT/KR2017/012626, dated Aug. 8, 2018, 14 pages.

*Primary Examiner* — Kenneth Bomberg
*Assistant Examiner* — Michael Quandt
(74) *Attorney, Agent, or Firm* — Sage Patent Group

(57) ABSTRACT

When a first control valve and a second control valve are in non-neutral positions, respectively, a fifth fluid passage and a second fluid passage are closed, thereby generating a first pressure within a fifth portion of the fifth fluid passage and a second pressure within a second portion of the second fluid passage, so that the first pressure is applied to a first valve through a fourth fluid passage to move the first valve to close the third fluid passage and a second pressure is applied to the confluence valve through a first fluid passage to move the confluence valve to a confluence position. When the confluence valve is in the confluence position, the confluence valve directs working fluid from a first working fluid supply to the second control valve.

11 Claims, 5 Drawing Sheets

(52) U.S. Cl.
CPC ..... *F15B 2211/20576* (2013.01); *F15B 2211/3116* (2013.01); *F15B 2211/329* (2013.01); *F15B 2211/355* (2013.01); *F15B 2211/6355* (2013.01)

(56) References Cited

U.S. PATENT DOCUMENTS

| | | | |
|---|---|---|---|
| 2004/0261405 | A1 | 12/2004 | Lee |
| 2005/0204734 | A1 | 9/2005 | Oka |
| 2008/0034748 | A1 | 2/2008 | Koo |
| 2008/0236154 | A1 | 10/2008 | Koo |

* cited by examiner

[Fig. 1]
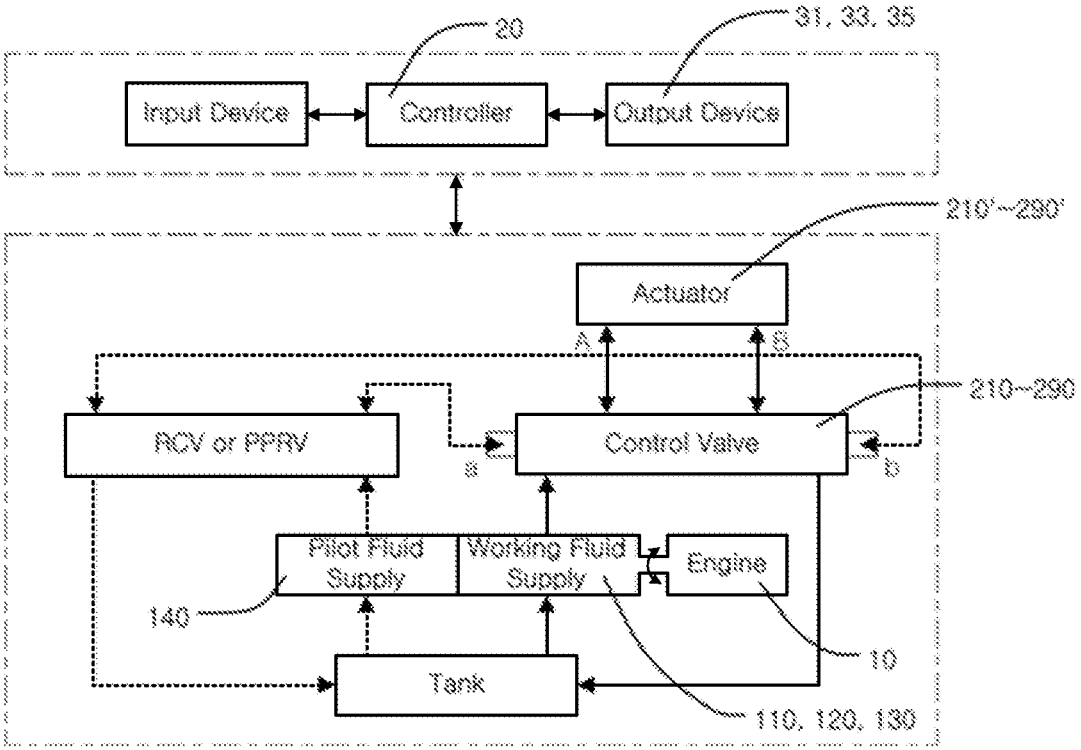

[Fig. 2]
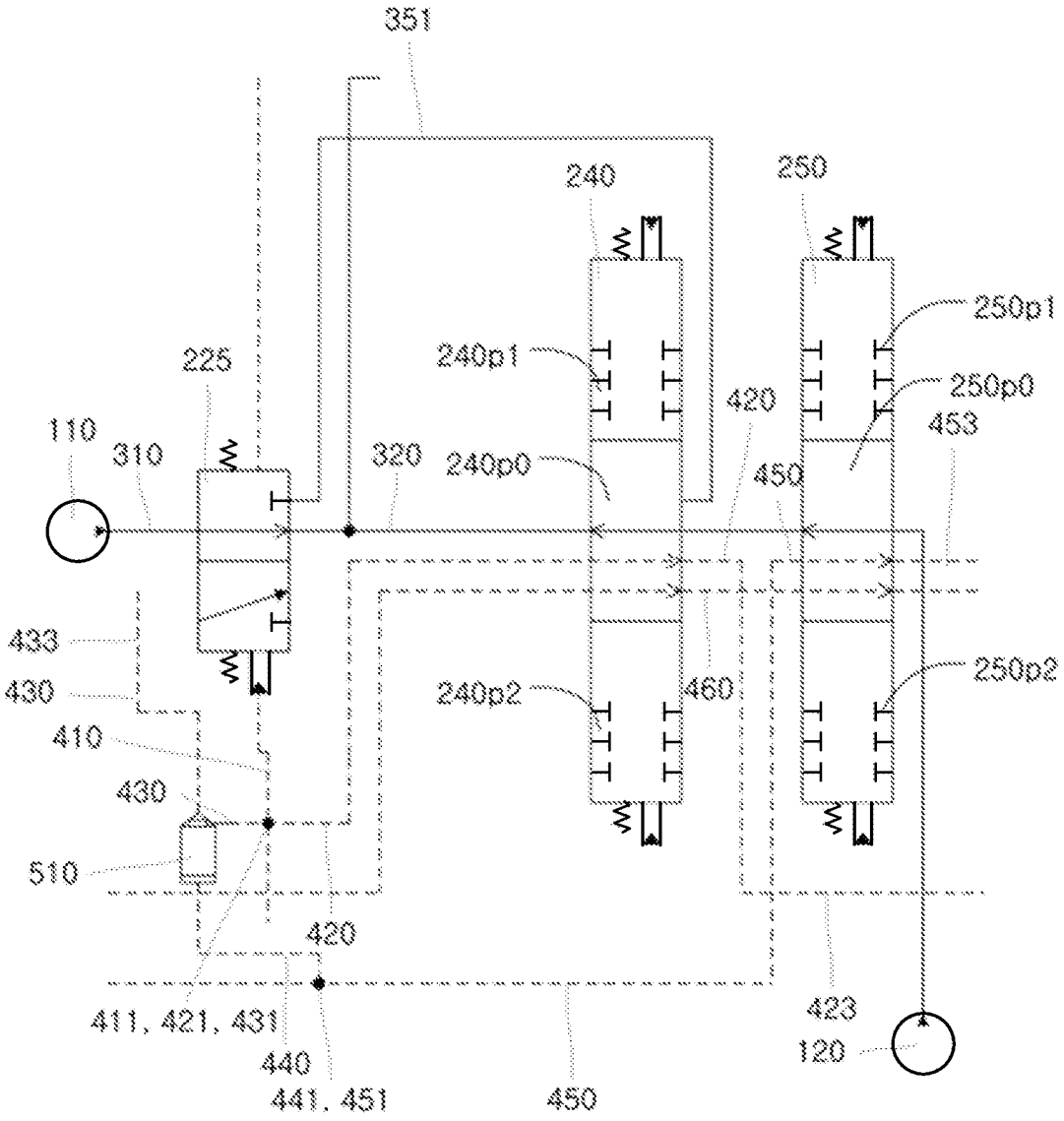

[Fig. 3]
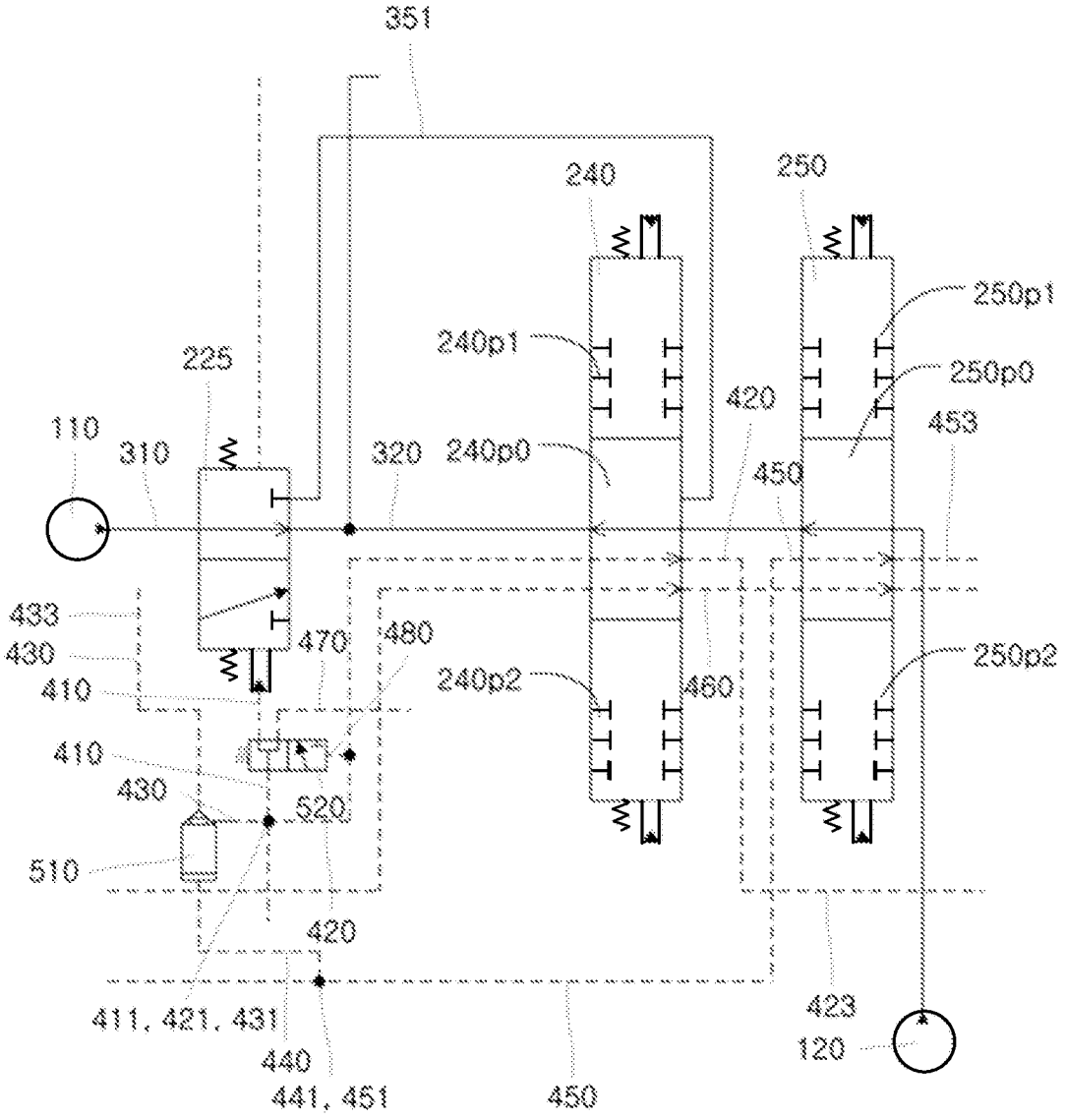

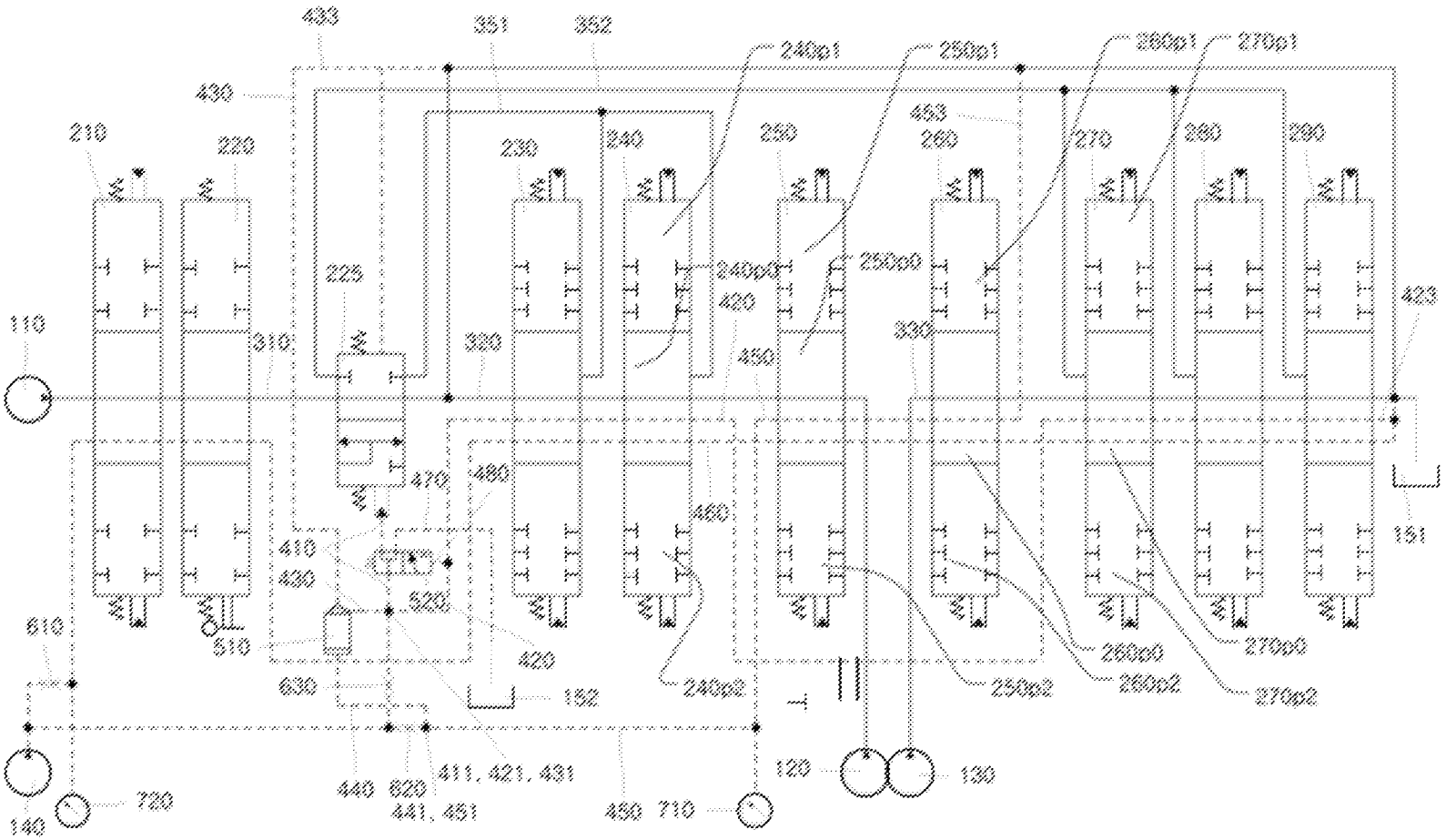
[Fig. 4]

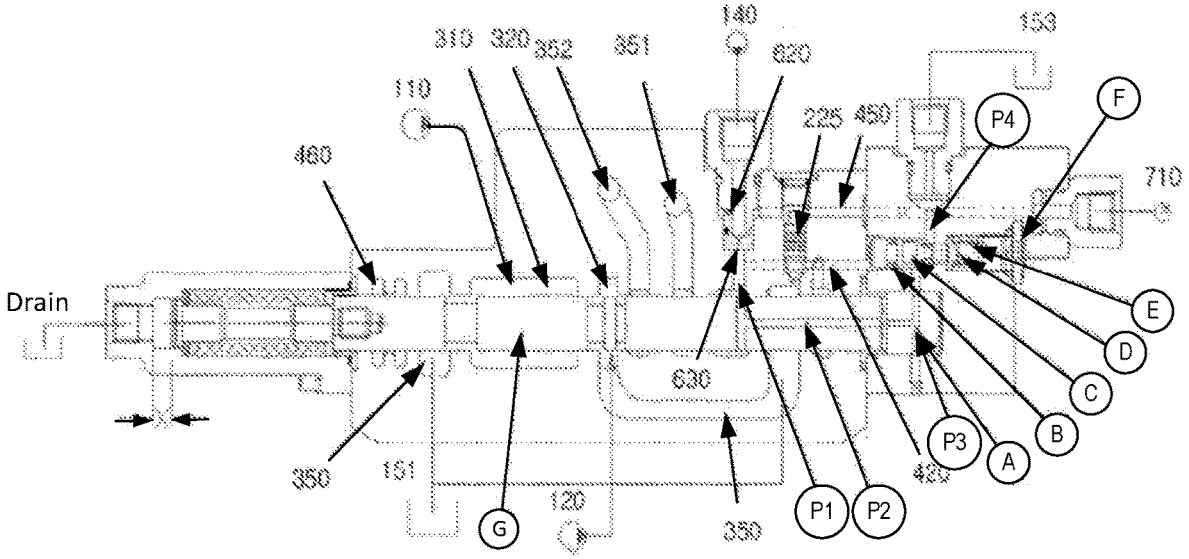
[Fig. 5]

HYDRAULIC CIRCUIT

CROSS REFERENCE TO RELATED APPLICATIONS

This application is a 35 U.S.C. § 371 national stage application of PCT International Application No. PCT/KR2017/012626 filed on Nov. 8, 2017, the disclosure and content of which is incorporated by reference herein in its entirety.

TECHNICAL FIELD

The present disclosure relates to a hydraulic circuit and, more particularly, to a hydraulic circuit having a confluence valve.

BACKGROUND ART

A variety of machines obtaining power by supplying pressurized fluid are used in construction sites, industrial sites, and the like. For example, such machines supply pressurized fluid to actuators, which in turn perform work using the pressure of the fluid.

A hydraulic circuit is generally provided with a plurality of working fluid supplies, each of which is configured to supply working fluid to a corresponding actuator. Some hydraulic circuits are provided with confluence valves, each of which can direct working fluid provided by a corresponding working fluid supply to an actuator corresponding to another working fluid supply. Thus, sufficient amounts of working fluid can be supplied to two or more actuators corresponding to different working fluid supplies when the two or more actuators are simultaneously driven.

However, a hydraulic circuit of the related art has a complexified structure and requires a large number of components, thereby increasing fabrication costs, lowering productivity, and making repairs difficult, which are problematic.

DISCLOSURE OF INVENTION

Technical Problem

Accordingly, the present disclosure has been made in consideration of the above-described problems occurring in the related art, and the present disclosure proposes a hydraulic circuit having a simple structure and excellent operational reliability.

Solution to Problem

According to an aspect of the present disclosure, a hydraulic circuit may include: a first working fluid supply; a second working fluid supply; a confluence valve connected to the first working fluid supply to control a flow of working fluid provided by the first working fluid supply; a first control valve and a second control valve connected to the second working fluid supply to control a flow of working fluid provided by the second working fluid supply; a first fluid passage including a first portion and connected to the confluence valve to move the confluence valve; a second fluid passage including a second portion fluidly communicating with the first portion of the first fluid passage, the second fluid passage extending from the second portion through the second control valve; a third fluid passage including a third portion fluidly communicating with the first portion of the first fluid passage and the second portion of the second fluid passage, the third fluid passage extending from the third portion; a first valve opening and closing the third fluid passage; a fourth fluid passage including a fourth portion and connected to the first valve to move the first valve; a fifth fluid passage including a fifth portion fluidly communicating with the fourth portion of the fourth fluid passage, the fifth fluid passage extending from the fifth portion through the first control valve. When the first control valve and the second control valve are in non-neutral positions, respectively, the fifth fluid passage and the second fluid passage may be closed, thereby generating a first pressure within the fifth portion of the fifth fluid passage and a second pressure within the second portion of the second fluid passage, so that the first pressure is applied to the first valve through the fourth fluid passage to move the first valve to close the third fluid passage and the second pressure is applied to the confluence valve through the first fluid passage to move the confluence valve to a confluence position. When the confluence valve is in the confluence position, the confluence valve may direct working fluid from the first working fluid supply to the second control valve.

The hydraulic circuit may further include: a third working fluid supply; and a third control valve and a fourth control valve connected to the third working fluid supply to control a flow of working fluid provided by the third working fluid supply. The second fluid passage may extend from the second portion to serially pass through the second control valve and the fourth control valve. The fifth fluid passage may extend from the fifth portion to serially pass through the first control valve and the third control valve. When at least one of the first control valve and the third valve is in a non-neutral position and at least one of the second control valve and the fourth control valve is in a non-neutral position, the fifth fluid passage may be closed to generate the first pressure within the fifth portion of the fifth fluid passage and the second fluid passage is closed to generate the second pressure within the second portion of the second fluid passage. When the confluence valve is in the confluence position, the confluence valve may direct working fluid from the first working fluid supply to one of the second control valve and the fourth control valve.

The hydraulic circuit may further include: a second valve provided on the first fluid passage; and a seventh fluid passage extending from the second valve. The second valve may have at least a first position and a second position. The second valve may allow fluid flow between the first fluid passage and the seventh fluid passage in the first position and blocks fluid flow between the first fluid passage and the seventh fluid passage in the second position.

BRIEF DESCRIPTION OF DRAWINGS

FIG. 1 schematically illustrates the configuration of a hydraulic machine according to exemplary embodiments;

FIG. 2 schematically illustrates the configuration of a hydraulic circuit according to exemplary embodiments;

FIG. 3 schematically illustrates the configuration of a hydraulic circuit according to exemplary embodiments;

FIG. 4 schematically illustrates the configuration of a hydraulic circuit according to exemplary embodiments; and FIG. 5 is a cross-sectional view schematically illustrating the structure of a confluence valve in the hydraulic circuit illustrated in FIG. 4.

MODE FOR THE INVENTION

Hereinafter, exemplary embodiments of the present disclosure will be described in detail with reference to the accompanying drawings.

A hydraulic circuit is applicable to hydraulic machinery, such as construction machines, industrial machines, and the like. The following exemplary embodiments referring to FIGS. 1 to 5 will disclose applications in which the hydraulic circuits are used in construction machines, such as an excavator. However, the present disclosure is not limited thereto, and the hydraulic circuits are applicable to a variety of machines using hydraulic pressure.

In this specification, illustrations or descriptions of devices and/or parts that are not directly related to the essential features of the present disclosure are omitted to focus on core features of the present disclosure. For example, in FIGS. 2 to 4, actuators and fluid passages connected to the actuators are not shown, and illustrations of fluid passages disposed within valves illustrated in FIGS. 2 to 4 are minimized. Specifically, fluid passages associated with non-neutral positions of (directional) control valves illustrated in FIGS. 2 to 4 are not shown, and fluid passages associated with neutral positions of control valves illustrated in FIGS. 2 to 4 are also omitted, except for those related to the present disclosure.

Although fluid passages mentioned herein may be entities physically independent of devices or components connected thereto, it may not be easy to physically distinguish the fluid passages from the devices or components. For example, fluid passages, such as hoses and pipes, via which a device is connected to another device, may be entities physically independent of devices connected thereto, but it may not be easy to mechanically or structurally distinguish fluid passages from valves when the fluid passages are internal fluid passages of a valve block in which a plurality of valves are assembled.

Although a fluid passage mentioned herein is referred to as a single component, the single component may, in fact, collectively refer to a combination of fluid passages that are mechanically or structurally distinguishable. For example, it will be apparent to a person having ordinary skill in the art that a fluid passage extending from a hydraulic pump toward a tank through a plurality of (directional) control valves in the neutral position is simply referred to as a center bypass passage. In contrast, although fluid passages mentioned herein are referred to as, and described as being, a plurality of components (e.g. focused on functional aspects), such fluid passages may, in fact, be portions of a conduit that are not mechanically or structurally distinguishable from the conduit.

The term "portion" of the fluid passage mentioned herein means a region considered to have a substantially uniform level of pressure. The expression "region considered to have a substantially uniform level of pressure" means that the pressure of the region is not only accurately uniform on a mathematical basis, but can also be seen to be uniform by a person having ordinary skill in the art. Thus, for example, a second portion 421 of a second fluid passage 420, in which a second pressure is formed when a second control valve 240 to be described with reference to FIG. 2 is closed, and a sixth portion 423 of a second fluid passage 420, downstream of the second control valve 240, cannot be the same portion in the specification.

The term "communication" used herein means the relationship between a "portion" of a fluid passage and a "portion" of another fluid passage, by which fluid having a specific level of pressure can flow therebetween without an intended increase or decrease in pressure. Thus, when one fluid passage is connected to another fluid passage via, for example, an orifice, the two fluid passages cannot be regarded as being in communication with each other. This is because, although one fluid passage provides fluid having a pressure level of, for example, 10 psi to the other fluid passage, the fluid received by the other fluid passage may have a pressure level of 5 psi, rather than the pressure level of 10 psi provided by the one fluid passage. That is, the same fluid is not sent and received in terms of pressure. However, the two fluid passages simply connected to each other may be regarded as communicating with each other, even in the case in which the pressure in one fluid passage is not the same as the pressure in the other fluid passage due to inevitable duct pressure loss.

The terms "communicating" and/or "connected" used herein include not only directly "communicating" and/or being "connected", but also indirectly "communicating" and/or to being "connected." For example, a person having ordinary skill in the art will understand that a hydraulic pump and a main control valve (MCV) "connected" to each other may be indirectly "connected" to each other via an intervening fluid passage.

FIG. 1 schematically illustrates the configuration of a hydraulic machine according to exemplary embodiments.

A construction machine, such as an excavator, includes a working part and a control part controlling the working part in electrical and mechanical communication with the working part.

The working part includes an engine 10, working fluid supplies 110, 120, 130, a pilot fluid supply 140, control valves 210-290, actuators 210', 220', 230', 240', 250', 260', 270', 280', 290', and a tank. When a working fluid supply 110, 120, 130 is driven by the engine 10, the working fluid supply 110, 120, 130 draws fluid from the tank and directs the fluid to a control valve 210-290. When the control valve 210-290 is in a neutral position 210*p*0-290*p*0, the control valve 210-290 allows the working fluid from the working fluid supply 110, 120, 130 to return to the tank, instead of directing the working fluid to the actuator 210', 220', 230', 240', 250', 260', 270', 280', 290'. When pilot fluid is supplied to portion 'a' of the control valve 210-290, the control valve 210-290 is moved to direct working fluid to portion 'A.' In contrast, when pilot fluid is supplied to portion 'b' of the control valve 210-290, the control valve 210-290 is moved to direct working fluid to portion 'B.' The actuator 210', 220', 230', 240', 250', 260', 270', 280', 290' performs work when provided with working fluid. The actuator 210', 220', 230', 240', 250', 260', 270', 280', 290' returns working fluid (working fluid supplied from the control valve in the case of a motor actuator and working fluid within an opposite chamber in the case of a cylinder actuator) to the control valve through an opposite portion (i.e. portion 'B' or portion 'A'). Working fluid from the actuator 210', 220', 230', 240', 250', 260', 270', 280', 290' returns to the tank, thereby forming a closed working fluid circuit. Such a working fluid circuit is generally referred to as a main circuit. Likewise, pilot fluid can also form a closed circuit. A pilot fluid supply 140 can draw fluid from the tank and send the fluid to a remote control valve (RCV) or an electro proportional pressure-reducing valve (EPPRV). The remote control valve or the electro proportional pressure-reducing valve provides pilot fluid to portion 'a' or portion 'b' of the control valve 210-290 in response to an input through an input device (e.g. a manipulator, such as a control lever, a control pedal, or a steering wheel). The control valve 210-290 is moved by pilot fluid provided thereto. Pilot fluid discharged from the opposite portion (portion 'b' or portion 'a') returns to the tank, thereby forming a closed circuit. Such a pilot fluid circuit is generally referred to as a pilot circuit.

Although a single working fluid circuit is illustrated and a single control valve is illustrated as being disposed within the single working fluid circuit for the sake of brevity in FIG. 1, a hydraulic machine may be provided with a plurality of working fluid supplies 110, 120, 130 and, from the point of view of the working fluid supplies 110, 120, 130, a plurality of circuits of working fluid may be included. (However, a hydraulic machine including a single tank, although including a plurality of working fluid supplies 110, 120, 130, may be regarded from the point of view of the tank as having a single working fluid circuit, since all flows of working fluid are supplied from the tank and return to the tank.) In addition, in each working fluid circuit, a plurality of control valves may be arranged in parallel, thereby forming a parallel circuit. In some such embodiments, a parallel circuit may have fluid passages referred to as parallel passages. Likewise, in the pilot fluid circuit, a plurality of RCVs (or a plurality of PPRVs) may be arranged in parallel, thereby forming a parallel circuit. Although a hydraulic machine is generally provided with a single pilot fluid circuit, the present disclosure is not limited thereto.

Although a hydraulic machine may be provided with a single tank providing fluid to a plurality of working fluid supplies 110, 120, 130 and a pilot fluid supply 140 and storing returning fluid, the present disclosure is not limited thereto. A hydraulic machine may be provided with a plurality of tanks. Although a plurality of tanks are described and illustrated in the specification and the accompanying drawings, this is merely for convenience of description, and a person having ordinary skill in the art will understand that only a single tank may, in fact, be provided. (If a variety of working fluid lines connected to a single tank were to be illustrated in a circuit diagram, the circuit diagram would be rendered complex and difficult to understand.) When the same number of tanks as illustrated in the drawings must be provided, it will be explicitly stated in the specification. Thus, when there is no such statement herein, a plurality of tanks illustrated in the drawings may be interpreted as being a plurality of tanks as illustrated in the drawings or may be interpreted as being a single tank or any other number of tanks. It should be understood that such embodiments are included within the scope of the present disclosure.

The control part includes a controller, an input device, an output device, and the like. The controller may include an electronic control unit (ECU). The ECU may include a central processing unit, a memory, and the like. The input device may include a variety of switches (e.g. a rotary switch, a membrane switch, and a toggle switch), a touchscreen, and the like, in addition to the above-described manipulator. The output device may include, for example, a video output device, such as a display or a lamp, an audio output device outputting sound, and a tactile output device outputting vibrations or the like.

The control part can provide a variety of functions. For example, the control part can provide an automatic idling function also referred to as an automatic deceleration function. This function can switch an engine 10 from a high-speed operation to a low-speed operation when an actuator has not performed any operation for a predetermined period of time (e.g. 4 to 6 seconds) during the high-speed operation of the engine 10, while allowing the engine 10 to return to the original high-speed operation when an operator operates the actuator by moving the manipulator. Additionally or alternatively, the control part can provide a travel alarm function. When a left traveling motor and/or a right traveling motor start to operate, the control part can detect the operation and output, for example, an audio signal using the output device 33, so that the operator can be informed of the operation.

FIG. 2 schematically illustrates the configuration of a hydraulic circuit according to exemplary embodiments.

As illustrated in FIG. 2, the hydraulic circuit includes a first working fluid supply 110, a second working fluid supply 120, a first control valve 250, a second control valve 240, a confluence valve 225, a first fluid passage 410, a second fluid passage 420, a third fluid passage 430, a fourth fluid passage 440, a fifth fluid passage 450, and a first valve 510.

In FIGS. 2 to 4, for the sake of brevity, only specific components closely related to features of the present disclosure, among components of the hydraulic circuit, are illustrated and other components are omitted. In addition, only specific fluid passages closely related to features of the present disclosure, among fluid passages connecting the illustrated components, are illustrated and other fluid passages are omitted. Furthermore, only specific fluid passages closely related to features of the present disclosure, among fluid passages within the illustrated components, are illustrated and other fluid passages are omitted.

The first working fluid supply 110 may be a hydraulic pump, and the second working fluid supply 120 may be a hydraulic pump.

The first control valve 250 and the second control valve 240 are connected to the second working fluid supply 120 to control a flow of working fluid provided by the second working fluid supply 120. When the first control valve 250 and the second control valve 240 are in a neutral position, working fluid from the second working fluid supply 120 can return to a tank (not shown) through a center bypass passage 320. Although the center bypass passage 32 in FIG. 2 extending between the second working fluid supply 120 and the tank sequentially passes through the first control valve 250 and the second control valve 240, the center bypass passage 320 may be configured to sequentially pass through the second control valve 240 and the first control valve 250. An actuator may be connected to each of the first control valve 250 and the second control valve 240. In some embodiments, the actuator connected to the first control valve 250 may be a traveling actuator, and the first control valve 250 may be a travel control valve controlling a flow of working fluid supplied to the traveling actuator. In some such embodiments, the traveling actuator may be a hydraulic motor. In some embodiments, the actuator connected to the second control valve 240 may be an attachment actuator, and thus the second control valve 240 may be an attachment control valve controlling a flow of working fluid supplied to the attachment actuator. In some such embodiments, the attachment may be, for example, a boom, an arm, or a bucket of an excavator, and the attachment actuator may be a hydraulic cylinder. In some embodiments, working fluid supplied to the actuator (in the case of the hydraulic cylinder, working fluid that has been in a chamber opposite to the chamber of the hydraulic cylinder to which working fluid is supplied) may return to the tank through the control valves 250 and 240.

The confluence valve 225 may be connected to the first working fluid supply 110 to control a flow of working fluid provided by the first working fluid supply 110. As illustrated in FIG. 2, when the confluence valve 225 is in a normal position, working fluid from the first working fluid supply 110 can return to the tank. When the confluence valve 225 is in a confluence position, working fluid from the first working fluid supply 110 is directed to the second control valve 240 through a confluence passage 351 and then to the actuator connected to the second control valve 240. In some embodiments, the confluence valve 225 may be a pilot-operated valve operated by pilot pressure, as illustrated in FIG. 2. In some embodiments, the confluence valve 225 may be configured to be moved to a confluence position by pilot pressure and to be restored to a normal position by spring force. However, the present disclosure is not limited thereto. In some embodiments, the confluence valve 225 may be configured to be moved to a confluence position when a pressure equal to or higher than a threshold pressure level is applied through the first fluid passage 410 to the confluence valve 225.

The first fluid passage 410 is connected to the confluence valve 225 to move the confluence valve 225. It is possible to move the confluence valve 225 to the confluence position by applying pilot pressure to the confluence valve 225 through the first fluid passage 410. The first fluid passage 410 has a first portion 411.

The second fluid passage 420 has a second portion 421 communicating with the first portion 411 of the first fluid passage 410. The second fluid passage 420 extends from the second portion 421 to the sixth portion 423 through the second control valve 240. At least while the second fluid passage 420 remains open, a pressure of fluid within the sixth portion 423 of the second fluid passage 420 may be lower than the threshold pressure level.

The third fluid passage 430 has a third portion 431 communicating with the first portion 411 of the first fluid passage 411 and the second portion 421 of the second fluid passage 420. The third fluid passage 430 extends from the third portion 431 to a seventh portion 433 through the first valve 510. At least while the third fluid passage 430 remains open, a pressure of fluid within the seventh portion 433 of the third fluid passage 430 may be lower than the threshold pressure level.

In embodiments in which the first portion 411 of the first fluid passage 410 communicates with the second portion 421 of the second fluid passage 420, i) further limitation of the third portion 411 of the third fluid passage 430 communicating with the first portion 411 of the first fluid passage 410, ii) further limitation of the third portion 411 of the third fluid passage 430 communicating with the second portion 421 of the second fluid passage 420, and iii) further limitation of the third portion 411 of the third fluid passage 430 communicating with both the first portion 411 of the first fluid passage 410 and the second portion 421 of the second fluid passage 420 commonly indicate the same circuit structure. Although a fluid passage extending vertically downwardly from the confluence valve 225 is described as the first fluid passage 410, a fluid passage branched and extending rightwardly from the first fluid passage 410 is described as the second fluid passage 420, and a fluid passage branched and extending leftwardly from the first fluid passage 410 is described as the third fluid passage 430 in FIG. 2, these are merely a result of selection for convenience of description. For example, only an upper portion of a fluid passage extending vertically downwardly from the first valve 510 may be referred to as the first fluid passage 410, while the remaining lower portion of the fluid passage and a fluid passage extending rightwardly may be collectively referred to as the second fluid passage 420. In addition, although the first portion 411 of the first fluid passage 410, the second portion 421 of the second fluid passage 420, and the third portion 431 of the third fluid passage 430 are illustrated as being in the same position in FIG. 2, this is merely a result of selection for convenience of description. Furthermore, although the first fluid passage 410, the second fluid passage 420, and the third fluid passage 430 are illustrated as joining at the same position in FIG. 2, the present disclosure is not limited thereto. For example, a circuit structure in which the third fluid passage 430 is directly connected to only the first fluid passage 410 or to only the second fluid passage 420 is equivalent to the circuit structure of FIG. 2.

The first valve 510 can open and close the third fluid passage 430. The first valve 510 may include a poppet movable between at least an open position in which the third fluid passage 430 is opened and a closed position in which the third fluid passage 430 is closed. Although the first valve 510 includes the poppet in the illustrated embodiments, the present disclosure is not limited thereto. For example, the first valve may include a spool.

The fourth fluid passage 440 is connected to the first valve 510 to move the first valve 510. The fourth fluid passage 440 has a fourth portion 441. Fluid within the third fluid passage 430 can apply an opening pressure to the poppet to move the poppet to the open position, while fluid within the fourth fluid passage 440 can apply a closing pressure to the poppet to move the poppet to the closed position. In some embodiments, the first valve 510 may be configured such that the first area of the poppet to which the opening pressure is applied is smaller than the second area of the poppet to which the closing pressure is applied. Even in the case in which the level of pressure received from the third fluid passage 430 is the same as the level of pressure received from the fourth fluid passage 440, the higher level of closing force is applied to the poppet, thereby closing the first valve 510. Although the first valve 510 movable by hydraulic pressure is illustrated, the present disclosure is not limited thereto. For example, the first valve may include a solenoid such that the first valve can be electrically moved.

The fifth fluid passage 450 has a fifth portion 451 fluidly communicating with the fourth portion 441 of the fourth fluid passage 440. The fifth fluid passage 450 extends from the fifth portion 451 to an eighth portion 453 through the first control valve 250. For example, when the first control valve 250 and the second control valve 240 are moved to non-neutral positions in response to an input device (e.g. in response to a manipulator, such as a control lever, a control pedal, or a steering wheel) being manipulated by an operator, the fifth fluid passage 450 and the second fluid passage 420 are closed, thereby generating a first pressure and a second pressure in the fifth portion 451 of the fifth fluid passage 450 and the second portion 421 of the second fluid passage 420, respectively. The first pressure is applied to the first valve 510 through the fourth fluid passage 440, thereby closing the first valve 510, while the second pressure is applied to the confluence valve 225 through the first fluid passage 410, thereby moving the confluence valve 225 to a confluence position. In some embodiments, the second pressure may be equal to or higher than the threshold pressure level. While the first control valve 250 remains in the neutral position, even in the case in which the second control valve 240 is moved to the non-neutral position, the first valve 510 is opened by pressure of fluid within the third fluid passage 430, since the first pressure is not generated within the fifth portion 451 of the fifth fluid passage 450, and the second pressure is not generated within the first fluid passage 410, since pressure within the third portion 431 of the third fluid passage 430 (consequently, pressure within the second portion 421 of the second fluid passage 420 and pressure within the first portion 411 of the first fluid passage 410) is discharged through the third fluid passage 430 to the seventh portion 433. In this regard, a product of the second pressure and the first area of the poppet of the first valve 510 can be greater than a product of the level of pressure of fluid within the eighth portion 453 of the fifth fluid passage 450 during opening of the fifth fluid passage 450 and the second area of the poppet of the first valve 510.

FIG. 3 schematically illustrates the configuration of a hydraulic circuit according to exemplary embodiments.

As illustrated in FIG. 3, the hydraulic circuit includes a second valve 520 provided on the first fluid passage 410 and a seventh fluid passage 470 extending from the second valve 520. The second valve 520 can have at least a first position and a second position. Although the second valve 520 may be configured to be moved to the second position by pilot pressure and to the first position, i.e. a normal position, by spring force, the present disclosure is not limited thereto. The second valve 520 can allow fluid flow between the first fluid passage 410 and the seventh fluid passage 470 in the first position and block fluid flow between the first fluid passage 410 and the seventh fluid passage 470 in the second position. In specific operating conditions, a high level of backpressure may be generated within the sixth portion 423 of the second fluid passage 420 (e.g. a high level of backpressure may be generated within a return line directed toward a tank 151 in FIG. 4, as will be described later, and consequently, within the sixth portion 423 of the second fluid passage 420), and the generated backpressure may be applied to the first fluid passage 410 through the second portion 421 of the second fluid passage 420. In this case, when the second control valve 240 is moved to a non-neutral position 240*p*1-240*p*2, even in the case in which the first valve 510 remains in an open position due to the first control valve 250 remaining in a neutral position 250*p*0, the confluence valve 225 can be moved to a confluence position by the high level of pressure within the first fluid passage 410. Here, working fluid from the first working fluid supply 110 is supplied to an attachment actuator 240' through the confluence valve 225 and the second control valve 240, so that an attachment or the like can abruptly operate at an unintended high speed. Thus, in some embodiments, the second valve 520 may be provided to drain the backpressure.

At least when the second valve 520 is in the first position, a level of pressure within the seventh fluid passage 470 is lower than a threshold pressure level. The seventh fluid passage 470 may extend from the second valve 520 to a tank (not shown). For example, the seventh fluid passage 470 may be a drain line extending between the second valve 520 and the tank. The hydraulic circuit may include an eighth fluid passage 480 connected to the second valve 520 to move the second valve 520. The eighth fluid passage 480 can fluidly communicate with the second fluid passage 420. When the second pressure is applied to the second valve 520 through the eighth fluid passage 480, the second valve 520 can be moved from the first position to the second position. According to the definition of the term "communication" as described above, the eighth passage 480 may be directly connected to the first fluid passage 410 to communicate with the second fluid passage 420 via the first fluid passage 410, instead of being directly connected to the second fluid passage 420. The second valve 520 may be a valve operated by a solenoid. In this regard, the hydraulic circuit includes detectors 710 and 720 detecting the second pressure within the second portion 421 of the second fluid passage 420. When the detectors 710 and 720 detect the second pressure, the hydraulic circuit can move the second valve 520 from the first position to the second position by applying an electrical signal to the solenoid.

FIG. 4 schematically illustrates the configuration of a hydraulic circuit according to exemplary embodiments, and FIG. 5 is a cross-sectional view schematically illustrating the structure of a confluence valve in the hydraulic circuit illustrated in FIG. 4.

As illustrated in FIG. 4, the hydraulic circuit includes a third working fluid supply 130 and third and fourth control valves 260 and 270 connected to the third working fluid supply 130 to control a flow of working fluid provided by the third working fluid supply 130. A fifth control valve 280 and a sixth control valve 290 are further provided to be connected to the third working fluid supply 130 to control a flow of working fluid provided by the third working fluid supply 130. When the third control valve 260 to the sixth control valve 290 are in neutral positions 260*p*0 and 290*p*0, working fluid from the third working fluid supply 130 can return to a tank 151 through a center bypass passage 330. Although the center bypass passage 330 extending between the third working fluid supply 130 and a tank 151 sequentially passes through the fourth control valve 270, the fifth control valve 280, and the sixth control valve 290 in FIG. 4, the center bypass passage 330 may be configured to pass through the control valves 260, 270, 280, and 290 in a different sequence. Actuators (not shown) may be connected to the third control valve 260 to the sixth control valve 290, respectively. In some embodiments, the actuator connected to the third control valve 260 may be a traveling actuator 260', and the third control valve 260 may be a travel control valve controlling a flow of working fluid supplied to the traveling actuator 260'. In some such embodiments, the traveling actuator 260' may be a hydraulic motor. In some embodiments, the actuators connected to the fourth control valve 270, the fifth control valve 280, and the sixth control valve 290 may be attachment actuators 270', 280', 290', and the fourth control valve 270, the fifth control valve 280, and the sixth control valve 290 may be attachment control valves controlling flows of working fluid supplied to the attachment actuators 270', 280', 290'. In some such embodiments, the attachments may be, for example, a boom, an arm, and a bucket of an excavator, and the attachment actuators may be hydraulic cylinders. In some embodiments, working fluid supplied to the actuators (in the case of the hydraulic cylinders, working fluid that has been in chambers opposite to the chambers of the hydraulic cylinders to which working fluid is supplied) may return to the tank 151 through the control valves 260, 270, 280, and 290, respectively.

As illustrated in FIG. 4, the hydraulic circuit further includes a seventh control valve 230 connected to the second working fluid supply 120 to control a flow of working fluid provided by the second working fluid supply 120. When the first control valve 250, the second control valve 240, and the seventh control valve 230 are in neutral positions 250*p*0, 240*p*0 and 230*p*0, working fluid from the second working fluid supply 120 can return to the tank 151 through the center bypass passage 320. Although the center bypass passage 320 extending between the second working fluid supply 120 and the tank 151 sequentially passes through the first control valve 250, the second control valve 240, and the seventh control valve 230 in FIG. 4, the center bypass passage 320 may pass through the valves 250, 240, and 230 in a different sequence. An actuator (not shown) may be connected to the seventh control valve 230. In some embodiments, the actuator connected to the seventh control valve 230 is an attachment actuator 230', and the seventh control valve 230 may be an attachment control valve controlling a flow of working fluid supplied to the attachment actuator 230'. In some such embodiments, the attachment actuator 230' may be a hydraulic cylinder.

As illustrated in FIG. 4, the hydraulic circuit further includes an eighth control valve 210 and a ninth control valve 220 connected to the first working fluid supply 110 to control a flow of working fluid provided by the first working fluid supply 110. When the eighth control valve 210, the ninth control valve 220, and the confluence valve 225 are in neutral positions, working fluid provided by the first working fluid supply 110 can return to the tank 151 through the center bypass passage 310. Although the center bypass passage 310 extending between the first working fluid supply 110 and the tanks 151 and 152 is illustrated as sequentially passing through the eighth control valve 210, the ninth control valve 220, and the confluence valve 225 in FIG. 4, the center bypass passage may pass through these valves in a different sequence. Actuators (not shown) may be connected to the eighth control valve 210 and the ninth control valve 220, respectively. In some embodiments, the actuator connected to the eight control valve 210 may be a swing actuator, and the eight control valve 210 may be a swing control valve controlling a flow working fluid supplied to the swing actuator. In some such embodiments, the swing actuator may be a hydraulic motor. In some embodiments, the actuator connected to the ninth control valve 220 may be a dozer blade actuator, and the ninth control valve 220 may be a dozer blade control valve controlling a flow working fluid supplied to the dozer blade actuator. In some such embodiments, the dozer blade actuator may be a hydraulic cylinder.

The second fluid passage 420 may extend from the second portion 421 to serially (or sequentially) pass through the seventh control valve 230, the second control valve 240, the fourth control valve 270, the fifth control valve 280, and the sixth control valve 290. The fifth fluid passage 450 extends from the fifth portion 451 to serially extend through the first control valve 250 and the third control valve 260.

When at least one of the second control valve 240, the fourth control valve 270, the fifth control valve 280, the sixth control valve 290, and the seventh control valve 230 is in a non-neutral position and at least one of the first control valve 250 and the third control valve 260 is in a non-neutral position, the second fluid passage 420 is closed, thereby generating a second pressure within the second portion 421 of the second fluid passage 420, and the fifth fluid passage 450 is closed, thereby generating a first pressure within the fifth portion 451 of the fifth fluid passage 450. When the confluence valve 225 is in a confluence position, the confluence valve 225 can direct working fluid from the first working fluid supply 110 to at least one of the second control valve 240, the fourth control valve 270, the fifth control valve 280, the sixth control valve 290, and the seventh control valve 230 through confluence passages 351 and 352.

As illustrated in FIG. 4, the sixth portion 423 of the second fluid passage 420, the seventh portion 433 of the third fluid passage 430, and the eighth portion 453 of the fifth fluid passage 450 can fluidly communicate with fluid passages extending toward the tank 151. The second control valve 240, the fourth control valve 270, the fifth control valve 280, the sixth control valve 290, and the seventh control valve 230 are connected to the confluence valve 225 in parallel.

As illustrated in FIG. 4, the hydraulic circuit may include a pilot fluid supply 140. The pilot fluid supply 140 may include a hydraulic pump. While the second fluid passage 420 remains open, fluid from the pilot fluid supply 140 can enter the second fluid passage 420 to flow from the second portion 421 through the second control valve 240. While the fifth fluid passage 450 remains open, fluid from the pilot pump can enter the fifth fluid passage 450 to flow from the fifth portion 451 through the first control valve 250.

The hydraulic circuit includes a first detector 710 detecting the first pressure and an output device 33 generating a travel alarm when the first pressure is detected.

In some embodiments, the hydraulic circuit may include an engine 10 driving the second working fluid supply 120, the first working fluid supply 110, the third working fluid supply 130, and the pilot fluid supply 140. The engine 10 may be a single engine driving all of these fluid supplies or may include a plurality of engines. The hydraulic circuit includes a sixth fluid passage 460 extending to serially (or sequentially) pass through the first to ninth control valves 250 220, detectors 710 and 720, a controller 20. When at least one of the first to ninth control valves 250 to 220 is moved to a non-neutral position 250*p*1-220*p*2, the sixth fluid passage 460 is closed, thereby generating a third pressure within the sixth fluid passage 460, and the detector 720 can detect the third pressure. When the third pressure is detected, the controller can deactivate the idling function of operating the engine 10 at a low speed.

As illustrated in FIG. 4, the hydraulic circuit includes orifices 610, 620, and 630.

Reference symbols P1, P2, P3, and P4 indicate fluid passages, and reference symbols A, B, C, D, E, F, and G indicate a piston, a seal, a spool, a guide, a spring, a plug, and a spool of the confluence valve 225, respectively.

The invention claimed is:

1. A hydraulic circuit comprising:

a first working fluid supply;

a second working fluid supply;

a confluence valve connected to the first working fluid supply, wherein the confluence valve is configured to control a flow of working fluid provided by the first working fluid supply;

a first control valve and a second control valve connected to the second working fluid supply, wherein the first control valve and the second control are configured to control a flow of working fluid provided by the second working fluid supply;

a first fluid passage comprising a first portion and connected to the confluence valve, wherein the first fluid passage is configured to move the confluence valve;

a second fluid passage comprising a second portion fluidly communicating with the first portion of the first fluid passage, wherein the second fluid passage is configured to render that fluid flowing through the second fluid passage passes from the second portion through the second control valve;

a third fluid passage comprising a third portion fluidly communicating with the first portion of the first fluid passage and the second portion of the second fluid passage;

a first valve, wherein the first valve is configured for opening and closing the third fluid passage;

a fourth fluid passage comprising a fourth portion and connected to the first valve, wherein the fourth fluid passage is configured to move the first valve;

a fifth fluid passage comprising a fifth portion fluidly communicating with the fourth portion of the fourth fluid passage, wherein the fifth fluid passage is configured to render that fluid flowing through the fifth fluid passage passes from the fifth portion through the first control valve;

wherein the first control valve and the second control valve are selectively operated in neutral positions and non-neutral positions;

wherein the first control valve and the second control valve in the non-neutral positions are configured to render that the fifth fluid passage and the second fluid passage are closed by the first control valve and the second control valve, thereby generating a first pressure within the fifth portion of the fifth fluid passage and a second pressure within the second portion of the second fluid passage, so that the first pressure is applied to the first valve through the fourth fluid passage to move the first valve to close the third fluid passage and so that the second pressure is applied to the confluence valve through the first fluid passage to move the confluence valve to a confluence position, and when the confluence valve is in the confluence position, the confluence valve directs working fluid from the first working fluid supply to the second control valve;

a second valve provided on the first fluid passage;

a seventh fluid passage extending from the second valve;

wherein the second valve is selectively in at least a first position and a second position; and wherein the second valve in the first position is configured to render that fluid flowing between the first fluid passage and the seventh fluid passage is allowed, and wherein the second valve in the second position is configured to render that fluid flowing between the first fluid passage and the seventh fluid passage is blocked.

2. The hydraulic circuit of claim 1, wherein the first control valve in the neutral position and the second control valve in the non-neutral position are configured to render that the first valve opens the third fluid passage.

3. The hydraulic circuit of claim 1, wherein the first control valve and the second control valve in the non-neutral positions are configured to further render that the confluence valve is moved to the confluence position when a pressure equal to or higher than a threshold pressure level is applied through the first fluid passage, and when the second pressure is equal to or higher than the threshold pressure level.

4. The hydraulic circuit of claim 3, wherein the second fluid passage further comprises a sixth portion, wherein the second fluid passage extends from the second portion to the sixth portion through the second control valve, and wherein the second fluid passage is configured to further render that the fluid flowing through the second fluid passage passes from the second portion to the sixth portion through the second control valve, and that while at least the second fluid passage remains open, a pressure of fluid within the sixth portion of the second fluid passage is lower than the threshold pressure level.

5. The hydraulic circuit of claim 3, wherein the third fluid passage further comprises a seventh portion, wherein the third fluid passage extends from the third portion to the seventh portion through the first valve, and wherein the third fluid passage is configured to further render that fluid flowing through the third fluid passage passes from the third portion to the seventh portion through the first valve, and that while at least the third fluid passage remains open, a pressure of fluid within the seventh portion of the third fluid passage is lower than the threshold pressure level.

6. The hydraulic circuit of claim 3, wherein the fifth fluid passage further comprises an eighth portion, wherein the fifth fluid passage extends from the fifth portion to the eighth portion through the first control valve, and wherein the fifth fluid passage is configured to further render that the fluid flowing through the fifth fluid passage passes from the fifth portion to the eighth portion through the first control valve.

7. The hydraulic circuit of claim 1 further comprising:

a pilot pump;

wherein the pilot pump is fluidly communicating with the second fluid passage and the fifth fluid passage; and wherein the pilot pump is configured to render that while the second fluid passage remains open, fluid provided by the pilot pump enters the second fluid passage from the second portion to flow through the second control valve, and that while the fifth fluid passage remains open, fluid provided by the pilot pump enters the fifth fluid passage from the fifth portion to flow through the first control valve.

8. The hydraulic circuit of claim 1, wherein the first control valve comprises a travel control valve for controlling a flow of working fluid, and wherein the second control valve comprises an attachment control valve for controlling a flow of working fluid.

9. The hydraulic circuit of claim 1, further comprising:

a detector detecting the first pressure for generation of a travel alarm.

10. The hydraulic circuit of claim 1, wherein the first control valve and the second control valve in the non-neutral positions are configured to further render that the confluence valve is moved to the confluence position when a pressure equal to or higher than a threshold pressure level is applied through the first fluid passage, and when a pressure of fluid within the seventh fluid passage is lower than the threshold pressure level.

11. The hydraulic circuit of claim 1 further comprising:

an eighth fluid passage connected to the second valve;

wherein the eighth fluid passage is configured to move the second valve;

wherein the eighth fluid passage fluidly communicates with the second portion of the second fluid passage and;

wherein the eighth fluid passage is configured to render that when the second pressure is applied to the second valve through the eighth fluid passage, the second valve is moved from the first position to the second position.

* * * * *